US008905668B2

(12) United States Patent
Edmondson et al.

(10) Patent No.: US 8,905,668 B2
(45) Date of Patent: Dec. 9, 2014

(54) ROTATABLE COSMETIC APPLICATOR

(75) Inventors: Mark Edmondson, Gennevilliers (FR); Eric Kerman, Chalon en Champagne (FR); Franck Seguin, Gennevilliers (FR); Eric Da Silva, Gennevilliers (FR)

(73) Assignee: Albea Services, Gennevilliers (FR)

( * ) Notice: Subject to any disclaimer, the term of this patent is extended or adjusted under 35 U.S.C. 154(b) by 691 days.

(21) Appl. No.: 13/090,876

(22) Filed: Apr. 20, 2011

(65) Prior Publication Data

US 2011/0262208 A1 Oct. 27, 2011

(30) Foreign Application Priority Data

Apr. 22, 2010 (EP) ..... 10305425

(51) Int. Cl.

| | |
|---|---|
| ***A45D 40/26*** | (2006.01) |
| ***A45D 34/04*** | (2006.01) |
| ***A46B 13/04*** | (2006.01) |
| ***A46B 9/02*** | (2006.01) |
| ***A46B 11/00*** | (2006.01) |
| ***A46B 13/00*** | (2006.01) |

(52) U.S. Cl.

CPC ..... *A45D 40/261* (2013.01); *A45D 34/04* (2013.01); *A45D 40/262* (2013.01); *A46B 9/021* (2013.01); *A46B 11/00* (2013.01); *A46B 11/0006* (2013.01); *A46B 11/0068* (2013.01); *A46B 13/001* (2013.01); *A46B 13/04* (2013.01); *A46B 2200/1053* (2013.01)

USPC ..... 401/219; 401/146; 222/101

(58) Field of Classification Search

USPC ..... 401/208, 218, 219, 220; 222/101

See application file for complete search history.

(56) References Cited

U.S. PATENT DOCUMENTS

| | | | | |
|---|---|---|---|---|
| 1,618,337 | A * | 2/1927 | Hoffman | 417/76 |
| 1,853,697 | A | 4/1932 | Oliver | |
| 2,163,355 | A | 6/1939 | Sechrist | |
| 2,763,882 | A | 9/1956 | Planka | |
| 3,263,862 | A * | 8/1966 | Tazzeo | 222/101 |
| 4,331,265 | A * | 5/1982 | Warlick | 222/101 |
| 4,535,499 | A | 8/1985 | Cho | |
| 5,397,193 | A * | 3/1995 | Kirk et al. | 401/122 |
| 5,401,113 | A | 3/1995 | Gueret | |

(Continued)

FOREIGN PATENT DOCUMENTS

| | | |
|---|---|---|
| CH | 184830 | 6/1936 |

OTHER PUBLICATIONS

European Search Report in corresponding European Patent Application No. EP 10305425, dated Sep. 22, 2010.

*Primary Examiner* — David Walczak
*Assistant Examiner* — Joshua Wiljanen
(74) *Attorney, Agent, or Firm* — Banner & Witcoff, Ltd.

(57) ABSTRACT

A cosmetic applicator comprises a body defining a handle, the body being arranged to receive the cosmetic product, a rotatable applicator element attached to a distal end of the body, the applicator element extending transversely relative to the body and being located proximate the cosmetic product, and a driving arrangement to rotate the applicator element, thereby loading the cosmetic product for subsequent application. In an embodiment, the body is elongate so as to define a longitudinal axis, with the applicator element extending perpendicular to the longitudinal axis of the body. In an embodiment, the cosmetic applicator comprises an actuating arrangement to allow a user to selectively control the position of the cosmetic product with respect to the applicator element, thereby allowing a controlled quantity of cosmetic product to be loaded onto the applicator element.

11 Claims, 7 Drawing Sheets

(56) References Cited

U.S. PATENT DOCUMENTS

| | | | | |
|---|---|---|---|---|
| 6,244,776 | B1 * | 6/2001 | Wiley | 401/208 |
| 6,390,708 | B1 * | 5/2002 | Gueret | 401/122 |
| 6,565,276 | B1 * | 5/2003 | Diaz | 401/129 |
| 6,616,366 | B1 * | 9/2003 | Weihrauch | 401/286 |
| 6,682,244 | B2 * | 1/2004 | Gueret | 401/208 |
| 7,172,357 | B2 * | 2/2007 | Gueret | 401/129 |
| 7,255,505 | B1 * | 8/2007 | Peterson | 401/6 |
| 7,278,798 | B1 * | 10/2007 | Kearney | 401/129 |
| 7,334,584 | B2 * | 2/2008 | Mathiez | 132/218 |
| 7,644,589 | B2 * | 1/2010 | Habatjou | 62/60 |
| 7,975,386 | B1 * | 7/2011 | Halvorson | 30/141 |
| 2005/0249541 | A1 * | 11/2005 | Habatjou | 401/220 |
| 2007/0071538 | A1 * | 3/2007 | Doria | 401/219 |
| 2009/0071500 | A1 * | 3/2009 | Wyatt et al. | 132/218 |
| 2009/0241980 | A1 * | 10/2009 | Wyatt et al. | 132/218 |
| 2010/0054849 | A1 * | 3/2010 | Petit | 401/219 |
| 2012/0114408 | A1 * | 5/2012 | Limongi et al. | 401/29 |
| 2012/0248140 | A1 * | 10/2012 | Iseri et al. | 222/1 |

* cited by examiner

ROTATABLE COSMETIC APPLICATOR

CROSS-REFERENCE TO RELATED APPLICATION

This application claims priority to European Application EP 10305425, filed Apr. 22, 2010, the entire disclosure of which is hereby incorporated by reference.

FIELD OF THE INVENTION

This invention relates to a rotatable cosmetic applicator to assist in the application of mascara.

BACKGROUND OF THE INVENTION

Mascara is a cosmetic used to darken, colour, thicken, lengthen, or define eyelashes. Mascara comes in three forms: liquid, cake, and cream. It also comes in many formulas, tints, and colours. The present invention is primarily aimed at the original, solid cake mascara product, as well as liquid mascara.

Traditionally, cake mascara is applied after rubbing a brush against the cake mascara solid to load it with product. This process has a number of disadvantages, one of which is an inability to control the quantity and uniformity of mascara loaded onto the brush. This is sometimes addressed by providing a wiper against which the brush can be wiped, with a wiper also being used in liquid mascara applicators. However, the use of a wiper to clean the brush or applicator will always leave more mascara product in two regions. In addition, there is always a "tail" left at the tip of the brush or applicator, which is a quantity of mascara that is not wiped, which makes the uniform application of mascara tricky and difficult.

Object of the Invention

It is therefore an object of the present invention to provide a rotatable mascara applicator that addresses the disadvantages described above.

SUMMARY OF THE INVENTION

According to the invention there is provided a cosmetic applicator for applying cosmetic product, the applicator comprising:

- a body defining a handle, the body being arranged to receive the cosmetic product;
- a rotatable applicator element attached to a distal end of the body, the applicator element extending transversely relative to the body and being located proximate the cosmetic product; and
- a driving arrangement to rotate the applicator element, thereby loading the cosmetic product for subsequent application.

In an embodiment, the body is elongate so as to define a longitudinal axis, with the applicator element extending perpendicular to the longitudinal axis of the body.

In an embodiment, the cosmetic applicator comprises an actuating arrangement to allow a user to selectively control the position of the cosmetic product with respect to the applicator element, thereby allowing a controlled quantity of cosmetic product to be loaded onto the applicator element.

In an embodiment, the actuating arrangement comprises a manually operable slider extending from the body, the slider terminating within the body in an actuating member to engage the cosmetic product so as to control the position of the cosmetic product with respect to the applicator element.

In an embodiment, the slider slides along a channel defined in the body, the channel being substantially aligned with the longitudinal axis of the body.

In an embodiment, the slider is biased towards a retracted position when the cosmetic applicator is not in use.

In one version of the invention, the mascara product is cake mascara accommodated within a receptacle, the receptacle being movable by the actuating member of the slider so as to control the position of the cosmetic product with respect to the applicator element.

In an alternate version of the invention, the mascara product is liquid mascara accommodated within a flexible housing, the actuating member of the slider comprising a roller to engage the housing to urge the cosmetic product towards the applicator element.

In this alternate version, the housing is a tapered wedge body that terminates in a dispensing grill proximate the applicator element, the dispensing grill defining a plurality of apertures through which the cosmetic product can be squeezed.

In an embodiment, the applicator element is a plastic injected brush.

Alternatively, the applicator element is a twisted wire type fibre brush.

In an embodiment, the body comprises a base, defining a first compartment to accommodate the cosmetic product and a second compartment to accommodate part of the driving arrangement, and a cover that can be secured to the base.

In an embodiment, the driving arrangement comprises:

- a motor accommodated within the second compartment, the motor comprising a rotatable shaft;
- a track extending between the rotatable shaft and the rotatable applicator element, so as to rotate the applicator element when the shaft is rotating; and
- a switch to activate rotation of the applicator element in use.

Alternatively, the driving arrangement comprises a spring arrangement that upon activation can convert stored mechanical energy in a spring to rotational kinetic energy to rotate the applicator element.

In an embodiment, the cosmetic applicator comprises a removable cap portion that can enclose the applicator element when the cosmetic applicator is not in use.

DESCRIPTION OF PREFERRED EMBODIMENTS

Figure 1:
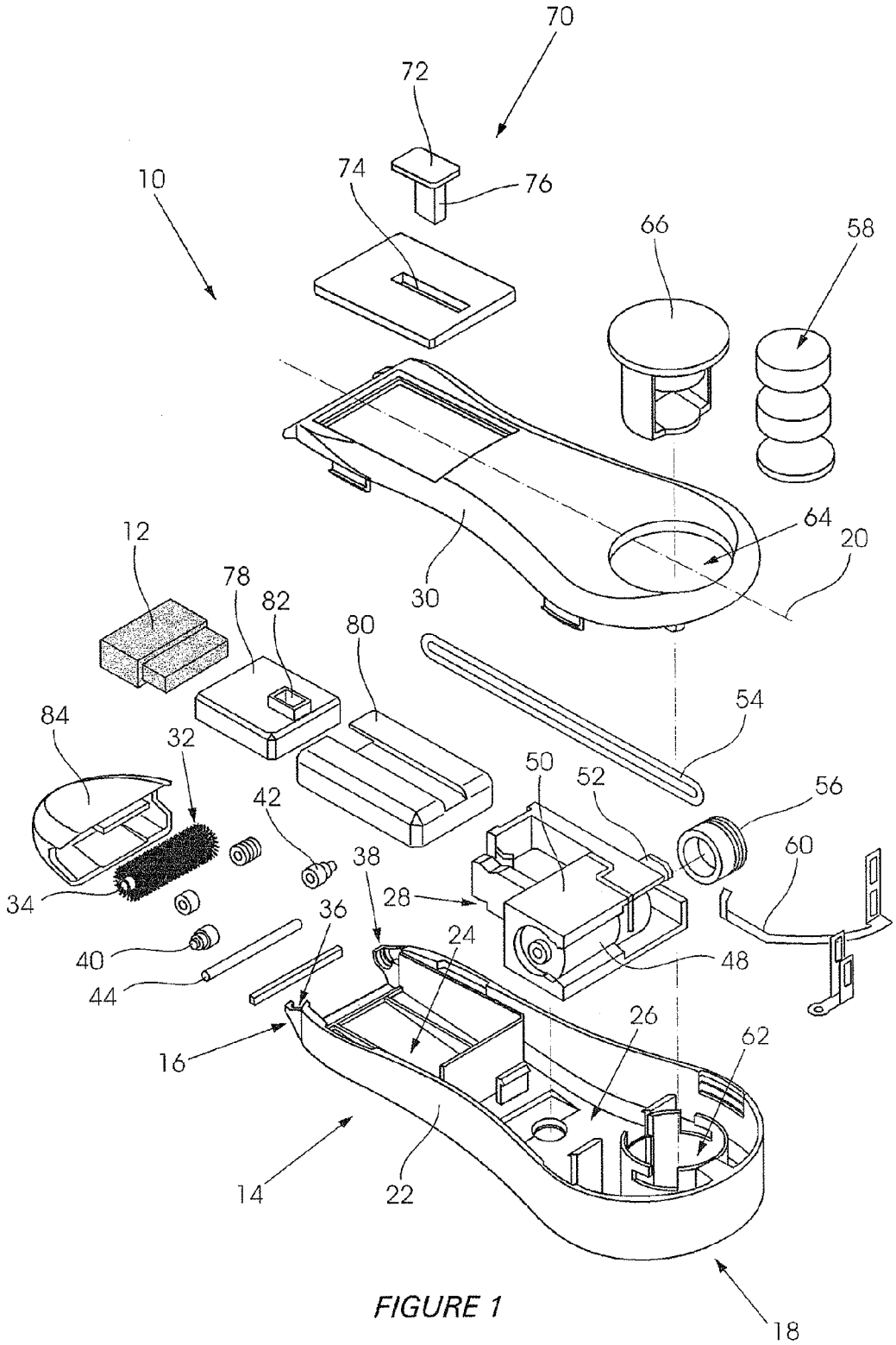
FIG. 1 shows an exploded perspective view of a cosmetic applicator according to a first example embodiment of the present invention, in which the cosmetic product to be dispensed is solid mascara cake.

Referring first to FIGS. 1 to 5, a cosmetic applicator 10 for applying cosmetic product 12, and, in particular, solid cake mascara, is shown. The applicator comprises a body 14 defining a handle, the body 14 being arranged to receive the cosmetic product 12. In particular, the body 14 defines a distal end 16 and a proximal end 18, as is elongate so as to define a longitudinal axis 20.

The body 14 comprises a base 22 that defines a first compartment 24 to accommodate the cosmetic product 12 and a second compartment 26 to accommodate part of a driving arrangement 28, which will be described in more detail further on in the specification. A cover 30 can be secured to the base 22 so as to define an elongate housing that can be easily and conveniently handled by a user wishing to apply the cake mascara product 12.

A rotatable applicator element 32 is removably attachable to the distal end 16 of the body 14. In an embodiment, the applicator element 32 comprises a central core 34, and the base 22 defines a pair of opposed axle holders 36, 38 to rotatably accommodate the central core 34 of the applicator element 32. In one version, stub axles 40, 42 and/or a shaft 44 may be secured to the applicator element 32 to assist in the rotation thereof.

Significantly, the applicator element 32 extends transversely relative to the body 14. In particular, the applicator element 32 extends perpendicular to the longitudinal axis 20 of the body 14.

Figure 2:
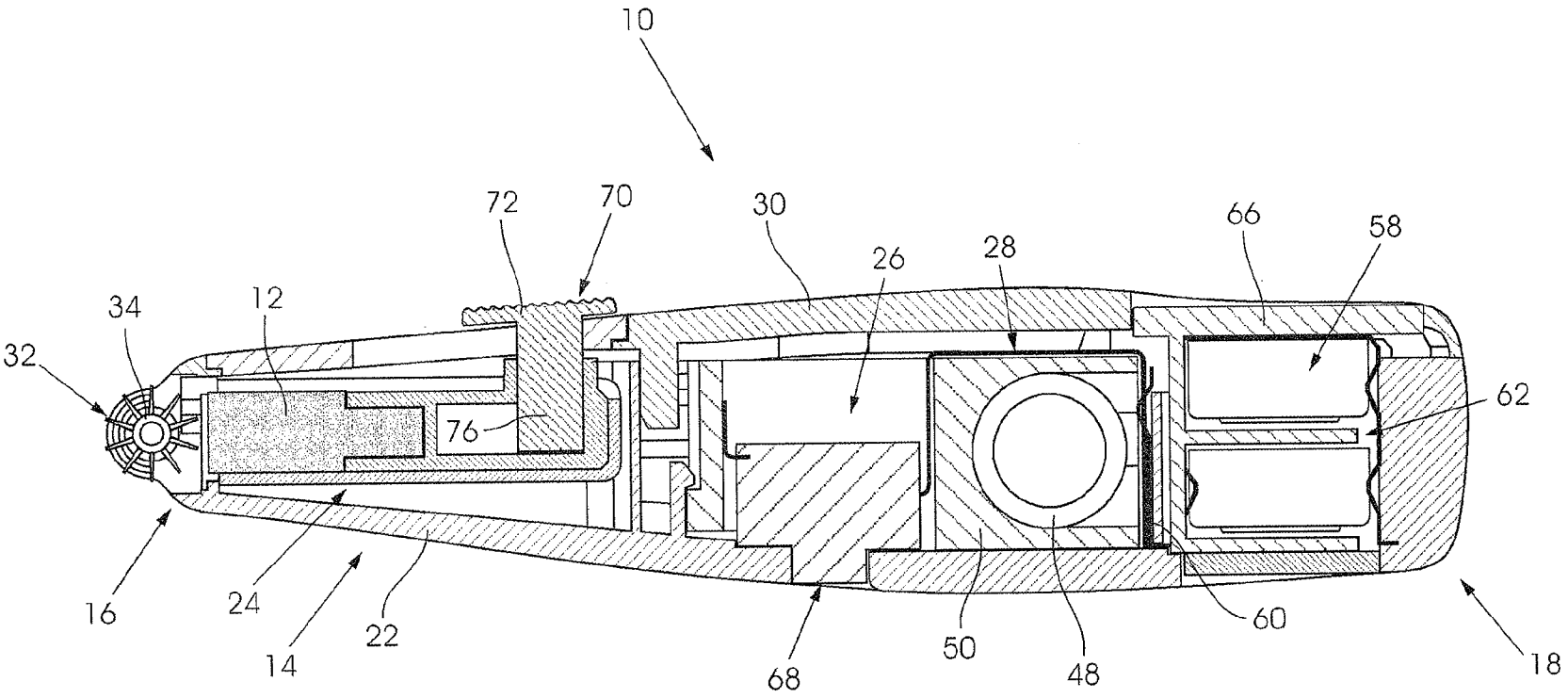
FIG. 2 shows a cross-sectional side view of the cosmetic applicator shown in FIG. 1, once assembled.
Figure 3:
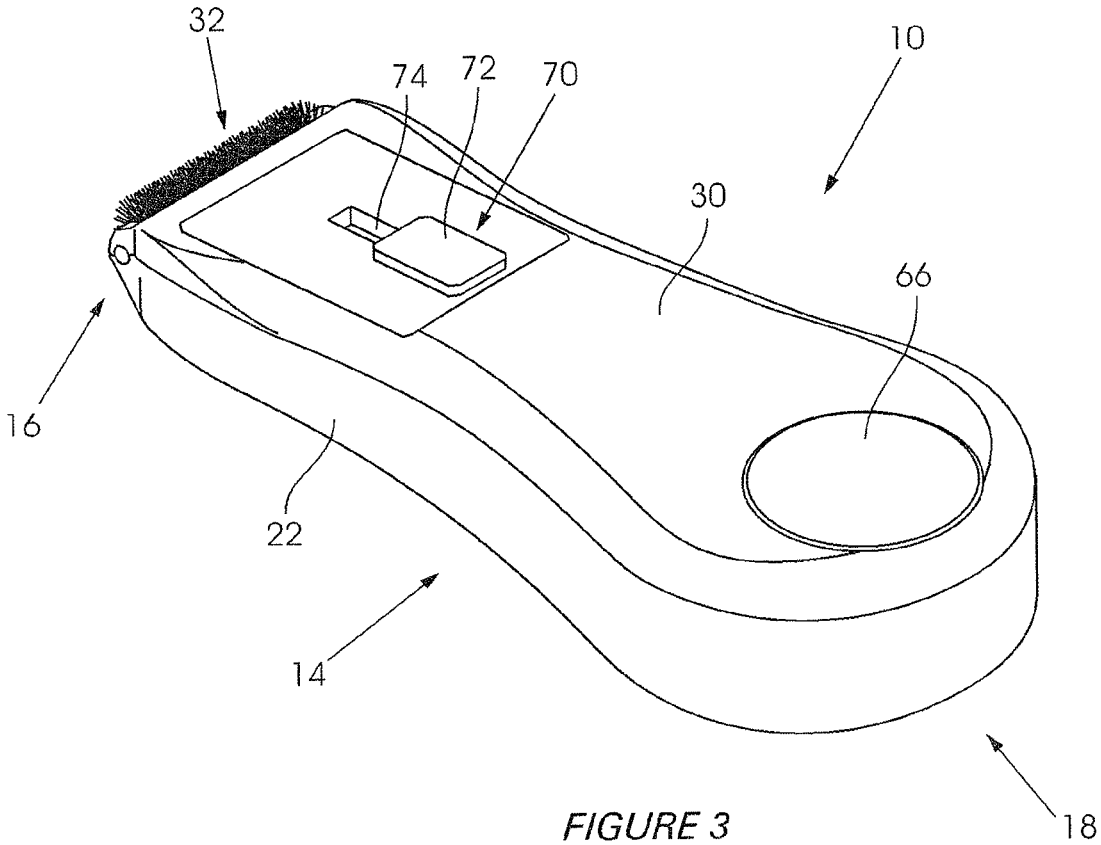
FIGS. 3, 4 and 5 show a perspective view, a top view and a side view, respectively, of the cosmetic applicator shown in FIG. 1, once assembled.
Figure 4:
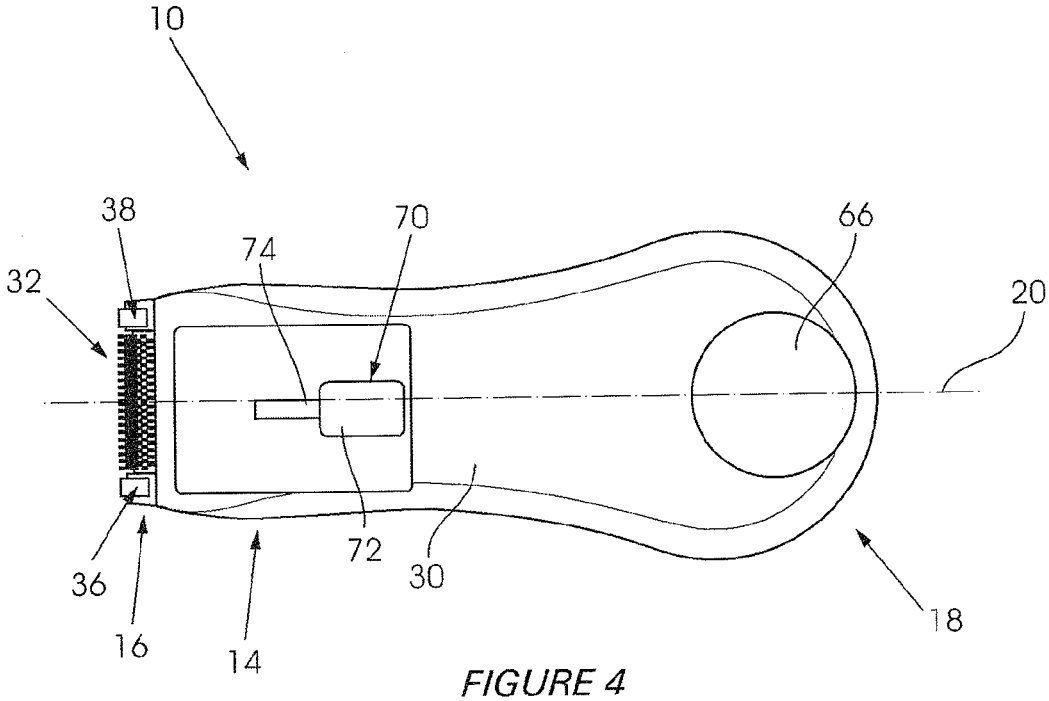
Figure 5:
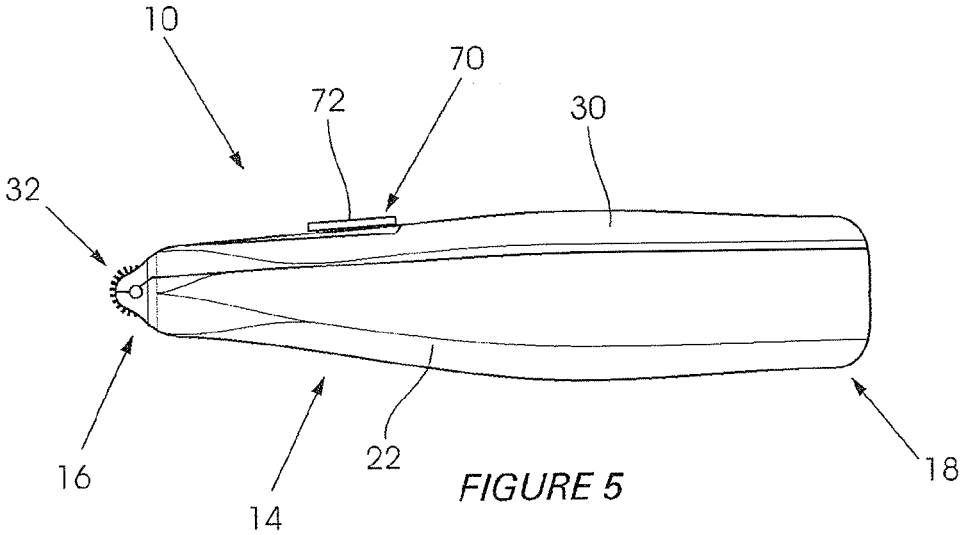
Figure 6:
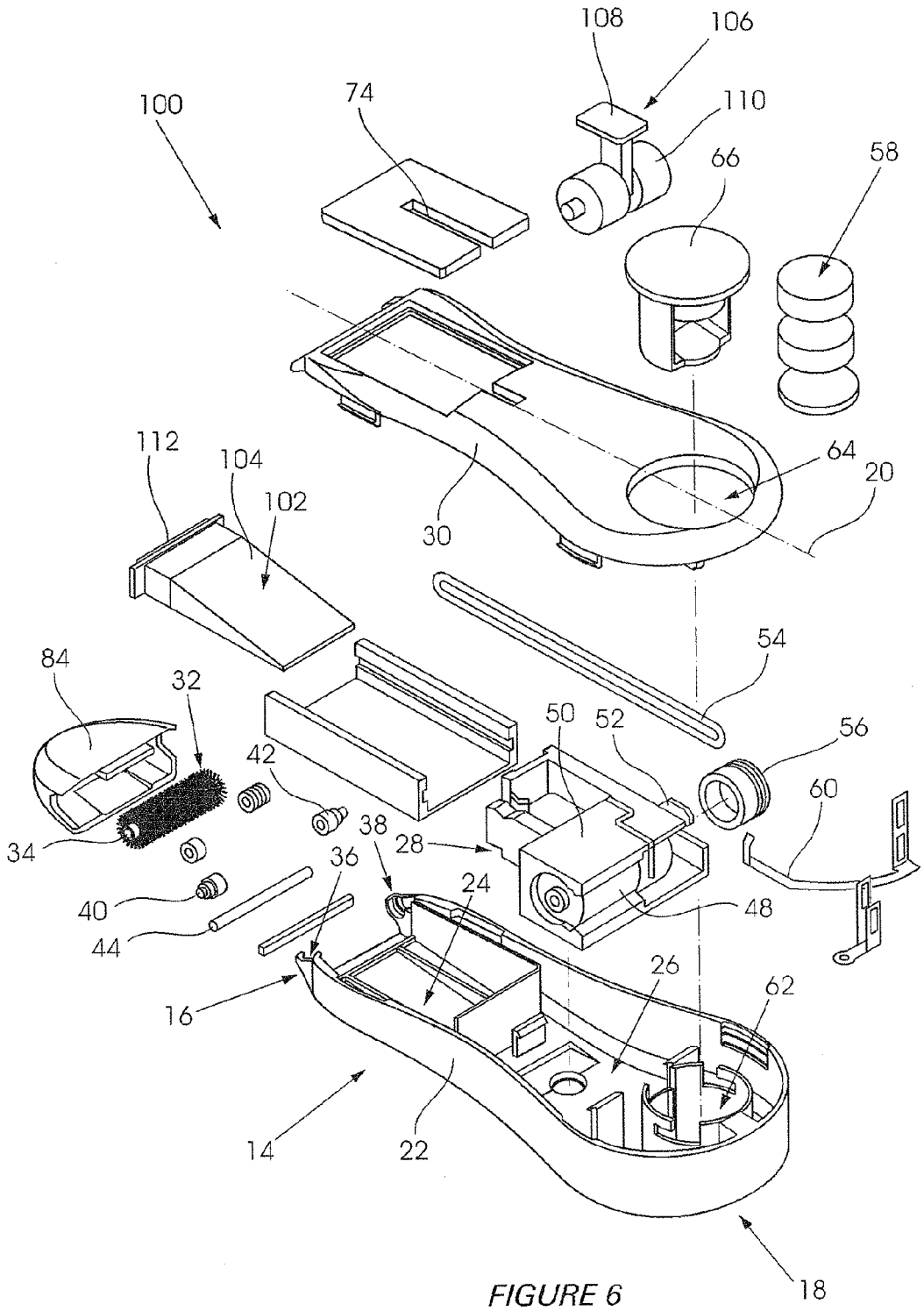
FIG. 6 shows an exploded perspective view of a cosmetic applicator according to a second example embodiment of the present invention, in which the cosmetic product to be dispensed is liquid mascara stored in a pouch.
Figure 7:
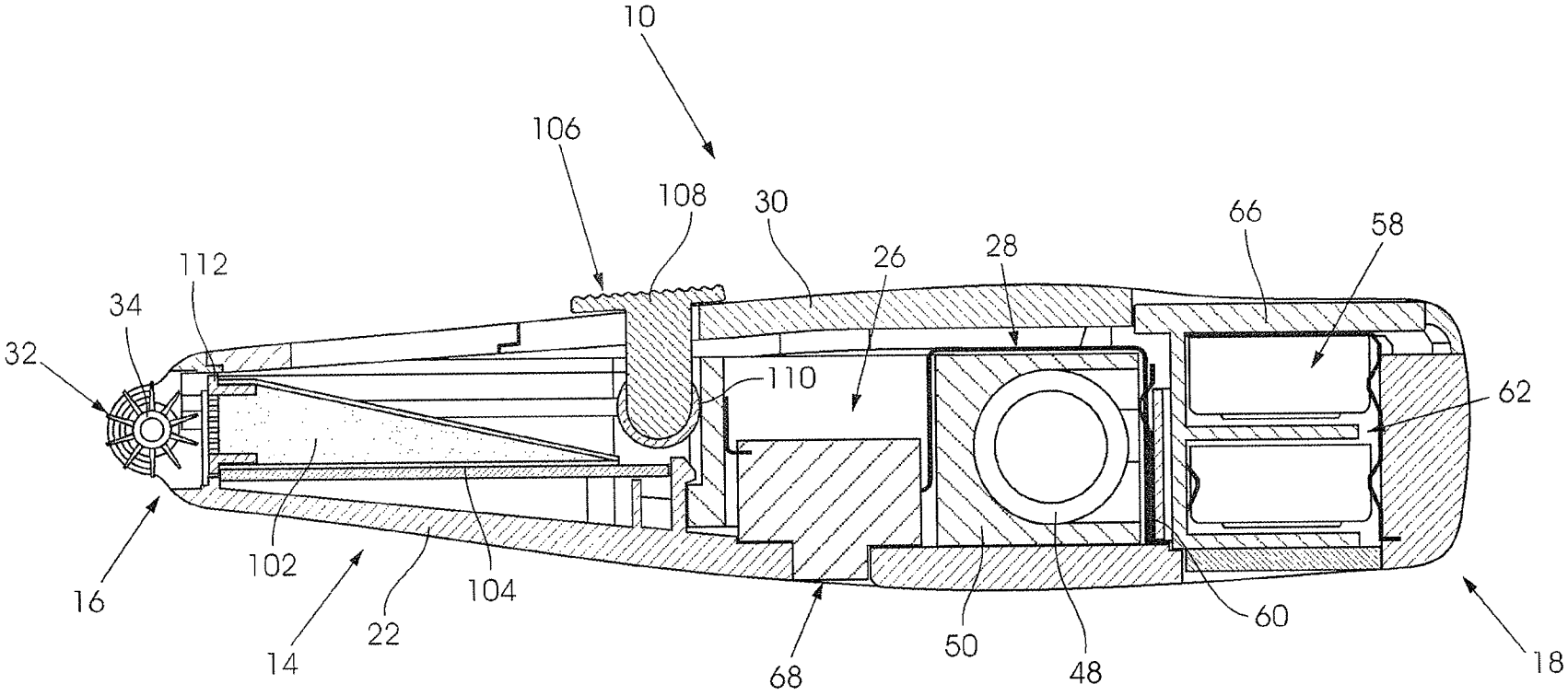
FIG. 7 shows a cross-sectional side view of the cosmetic applicator shown in FIG. 6, once assembled.
Figure 8:
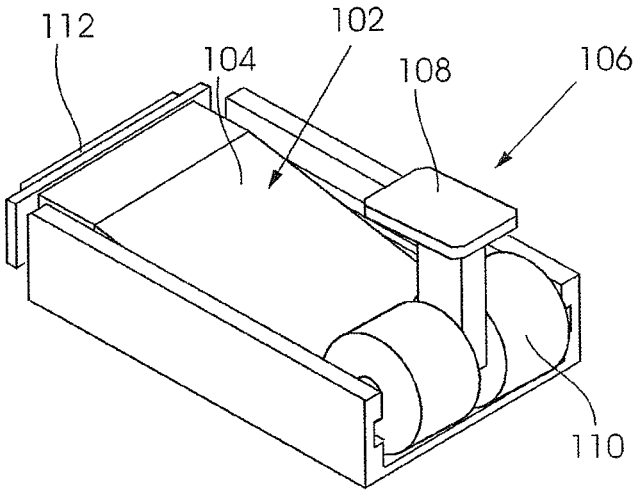
FIG. 8 shows a detailed perspective view of an actuating arrangement used in the cosmetic applicator shown in FIGS. 6 and 7.
Figure 9:
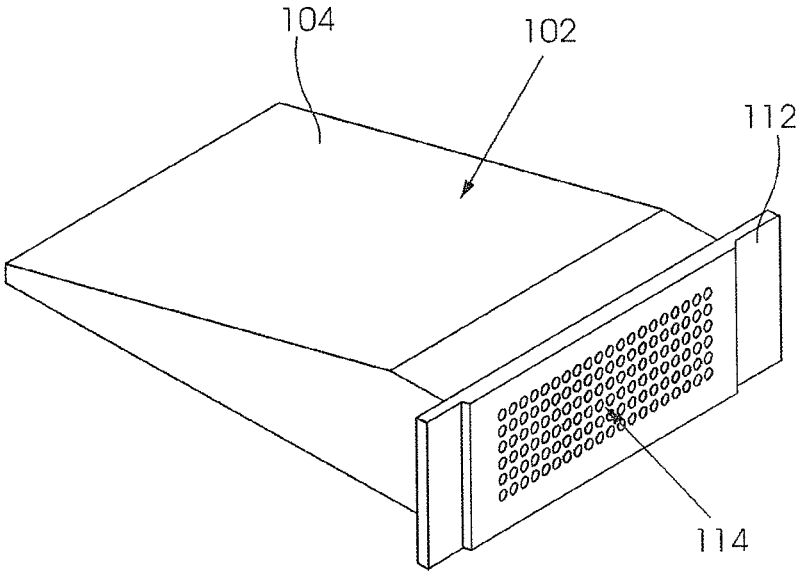
FIG. 9 shows a perspective view of the mascara pouch used in the cosmetic applicator shown in FIGS. 6 to 9.

As described above, the cosmetic applicator 10 further comprises a driving arrangement 28 to rotate the applicator element 32. As best shown in FIG. 2, the applicator element 32 is located sufficiently proximate the cosmetic product 12, so that the rotating applicator element 32 can be loaded with the cosmetic product 12 for subsequent application.

In an embodiment, the driving arrangement 28 comprises a motor 48 secured to a motor mount 50, which in turn is snugly accommodated within the second compartment 26. The motor 48 comprises a rotatable shaft 52. The driving arrangement 28 further comprises a track 54, in the form of cord or band, extending between the rotatable shaft 52 and the rotatable applicator element 32. In particular, the track 54 may fit around a connector 56 fitted to the shaft 52 and either the central core 34 of the applicator element 32 or one of the stub axles 40, 42.

As is well known in the art, the motor 48 may be powered by batteries 58, with an electrical connector 60 electrically connecting the motor 48 and batteries 58. A battery housing 62 is provided to accommodate the batteries 58.

Cover 30 defines a battery housing aperture 64 for facilitating the insertion and removal of the batteries 58 from/into the battery housing 62. A cap 66 is provided to close the aperture 64 and to keep the batteries 58 in place within the housing 62.

A switch 68 is provided to activate rotation of the shaft 52, and thus the applicator element 32, in use. Optionally, an additional control means (not shown) may be provided allowing switch direction of rotation (clockwise or counter-clockwise). A further optional feature may include the ability to vary the speed of rotation of the applicator.

Although not shown, the driving arrangement 28 may alternatively comprise a spring arrangement that upon activation can convert stored mechanical energy in a spring to rotational kinetic energy to rotate the applicator element 32.

In an embodiment, the cosmetic applicator 10 comprises an actuating arrangement 70 to allow a user to selectively control the position of the cosmetic product 12 with respect to the applicator element 32. This conveniently allows a controlled quantity of cosmetic product 12 to be loaded onto the rotating applicator element 32 when in use.

The actuating arrangement 70 may comprise a manually operable slider or button 72 arranged to slide along a channel 74 defined in the cover 30 of the body 14. The channel 74 is substantially aligned with the longitudinal axis 20 of the body 14. The slider 72 terminates within the body 14 in an actuating member 76 to engage the cosmetic product 12 so as to control the position of the cosmetic product 12 with respect to the applicator element 32, as described above.

Although not shown, the slider 72 may be biased towards a retracted position when the cosmetic applicator 10 is not in use.

As mentioned above, in the version of the invention shown in FIGS. 1 to 5, the mascara product 12 is cake mascara that is snugly accommodated in place within a receptacle 78. The receptacle 78 is movable by the actuating member 76 of the slider 72, within a housing 80 fitted within the first compartment 24 of the base 22 of the body 14. In one version, the receptacle 78 comprises a protruding receiving formation 82 to receive the actuating member 76 of the slider 72.

In an embodiment, the cosmetic applicator 10 comprises a removable cap portion 84 that can enclose the applicator element 32 when the cosmetic applicator 10 is not in use.

Turning now to FIGS. 6 to 9, an alternate version of a cosmetic applicator 100 is shown. The cosmetic applicator 100 has a number of identical components to that of cosmetic applicator 10 in FIGS. 1 to 5. These identical components have been numbered similarly, and their operation will not be repeated for the sake of brevity.

In this alternate embodiment, the mascara product 102 is liquid mascara accommodated within a flexible housing or pouch 104. The actuating member 106 of the slider 108 comprises a roller 110 to engage the housing 104 so as to urge the cosmetic product 102 towards the applicator element 32.

The housing 104 may take the form of a tapered wedge body that terminates in a dispensing grill 112 proximate the applicator element 32. The dispensing grill 112 defines a plurality of apertures 114 through which the cosmetic product 102 can be squeezed.

In both embodiments, the applicator element 32 may comprise either a twisted wire type fibre brush or a plastic injected brush.

Advantageously, the bulk 12, receptacle 78 and housing 80 may be provided as a replaceable unit. In such a configuration, the user may purchase a new unit and replace it in the housing once the cosmetic product 12 runs out.

The present invention thus provides a convenient and easy to use cosmetic applicator to enable a user to load and a apply a controlled quantity of mascara. For example, for a more pronounced makeup effect, the cosmetic applicator may be loaded with more product simply by bringing the mascara product closer to the applicator element. A further advantage is that there is no need for a wiper anymore.

The invention claimed is:

1. A cosmetic applicator for applying cosmetic product, the applicator comprising:

a body defining a handle, the body being arranged to receive the cosmetic product;

a rotatable applicator element attached to a distal end of the body, the applicator element extending transversely relative to the body and being located proximate the cosmetic product;

a driving arrangement configured to rotate the applicator element, and thereby load the cosmetic product for subsequent application;

a flexible housing positioned within the cosmetic applicator wherein the flexible housing contains the cosmetic product, wherein the cosmetic product is liquid mascara, and an actuating arrangement to allow a user to selectively control the position of the cosmetic product with respect to the applicator element, thereby allowing a controlled quantity of cosmetic product to be loaded onto the applicator element;

wherein the actuating arrangement comprises a manually operable slider extending from the body, the slider terminating within the body in an actuating member engaging the flexible housing to urge the cosmetic product towards the applicator element.

2. The cosmetic applicator of claim 1, wherein the body is elongate so as to define a longitudinal axis, with the applicator element extending perpendicular to the longitudinal axis of the body.

3. The cosmetic applicator of claim 1, wherein the slider is configured to slide along a channel defined in the body, the channel being substantially aligned with the longitudinal axis of the body.

4. The cosmetic applicator of claim 3, wherein the slider is biased towards a retracted position when the cosmetic applicator is not in use.

5. The cosmetic applicator of claim 1, wherein the actuating member of the slider comprises a roller configured to engage the flexible housing and to urge the cosmetic product towards the applicator element.

6. The cosmetic applicator of claim 5, wherein the housing is a tapered wedge body that terminates in a dispensing grill proximate the applicator element, the dispensing grill defining a plurality of apertures through which the cosmetic product can be squeezed.

7. The cosmetic applicator of claim 1, wherein the applicator element is a twisted wire type fiber brush.

8. The cosmetic applicator of claim 1, wherein the applicator element is a plastic injected brush.

9. The cosmetic applicator of claim 1, wherein the body comprises a base, defining a first compartment to accommodate the cosmetic product and a second compartment to accommodate part of the driving arrangement, and a cover that can be secured to the base.

10. The cosmetic applicator of claim 9, wherein the driving arrangement comprises:

a motor comprising a rotatable shaft;

a track extending between the rotatable shaft and the rotatable applicator element, and configured to rotate the applicator element when the shaft is rotating; and a switch configured to activate rotation of the applicator element in use.

11. The cosmetic applicator of claim 1, which further comprises a removable cap portion that can enclose the applicator element when the cosmetic applicator is not in use.

* * * * *